US010018447B1

(12) United States Patent
Alford

(10) Patent No.: US 10,018,447 B1
(45) Date of Patent: Jul. 10, 2018

(54) HINGED HOLSTER FOR A FIREARM

(71) Applicant: Michael B Alford, Weatherford, TX (US)

(72) Inventor: Michael B Alford, Weatherford, TX (US)

( * ) Notice: Subject to any disclaimer, the term of this patent is extended or adjusted under 35 U.S.C. 154(b) by 0 days.

(21) Appl. No.: 15/275,328

(22) Filed: Sep. 23, 2016

Related U.S. Application Data

(60) Provisional application No. 62/222,592, filed on Sep. 23, 2015.

(51) Int. Cl.
*F41C 33/02* (2006.01)
*F41C 33/04* (2006.01)

(52) U.S. Cl.
CPC ..... *F41C 33/0272* (2013.01); *F41C 33/0236* (2013.01); *F41C 33/048* (2013.01)

(58) Field of Classification Search
CPC . F41C 33/0272; F41C 33/0236; F41C 33/048
See application file for complete search history.

(56) References Cited

U.S. PATENT DOCUMENTS 2,893,615 A * 7/1959 Couper ..... F41C 33/0236 224/193
5,234,145 A * 8/1993 Padin ..... F41C 33/0218 224/192
8,302,827 B1 11/2012 Cole
2015/0041513 A1* 2/2015 Hawks, Jr. ..... F41C 33/0272 224/676
2016/0061564 A1* 3/2016 Gordon ..... F41C 33/041 224/587

OTHER PUBLICATIONS

New .380 Concealed Carry Holster; http://www.gripus.com/380%20Holster.htm.
Wallet Holster; http://gouldusa.com/products/showModel.php?id_main=12.
Humphries, Michael O., "15 Top Pocket Holsters", www.AmericanRifleman.org, Jun. 9, 2016; https://www.americanrifleman.org/articles/2016/6/9/15-top-pocket-holsters/.
Alabama Holster—Back Pocket Holster; http://www.alabamaholster.com/product/back-pocket-holster/.
Kee, Tyler, "Gear Review: Comp-Tac Paddle Holster", www.TheTruthAboutGuns.com, May 31, 2012; http://www.thetruthaboutguns.com/2012/05/tyler-kee/gear-review-comp-tac-paddle-holster/.
Recluse Kahr P3801CW380 Recluse OS Solo; http://www.recluseholster.com/product_info.php?manufacturers_id=8&products_id=25.
Recluse Kahr P380/CW380 Recluse TS Solo; http://www.recluseholster.com/product_info.php?manufacturers_id=8&products_id=45.
The ABDO—Concealed carry Portable Safe; http://theabdo.com/.
Dynamite Gun Works—Trigger Guard Holster; http://www.dynamitegunworks.com/trigger-guard-holster/.
XD Gear One Piece Paddle Holster; http://store.springfield-armory.com/Shop/pc/XD-GEAR-ONE-PIECE-PADDLE-HOLSTER-p83.htm.
Talon Kahr CW380 and P380 and Remington RM380 Wallet Holster; https://www.talonholsters.com/talon-kahr-cw380-p380-remington-rm380-wallet-holster-p-19143.html.

* cited by examiner

*Primary Examiner* — Corey Skurdal
(74) *Attorney, Agent, or Firm* — Lightfoot & Alford PLLC

(57) ABSTRACT

A firearm holster has a plate, a firearm enclosure configured to carry a firearm, and an elastic hinge. The hinge couples the plate to the enclosure and allows for relative motion between the plate and enclosure about the hinge. This relative motion about the elastic hinge during use allows for parts of a hand of a user to be inserted between the plate and enclosure when establishing or maintaining a grip on a firearm carried by the holster.

20 Claims, 18 Drawing Sheets

HINGED HOLSTER FOR A FIREARM

BACKGROUND

Field of the Invention

This disclosure relates in general to accessory equipment for firearms and in particular to hinged holsters for firearms.

Description of Related Art

Many concealment-holster designs allow for ease of access to a firearm carried by the holster. However, these designs often require the user to first establish a non-proper grip on the firearm and then, after the firearm is withdrawn from the holster, shift the firearm within the hand or move parts of the hand to achieve a proper grip. Some designs allow for a proper grip while the firearm is within the holster, but the designs may limit the ability to withdraw the firearm, proper grip or not, when, for example, the user is in a seated position or otherwise applying pressure directly to the holster or to the clothing in the area near the holster.

CLAIM OF PRIORITY

Figure 1:
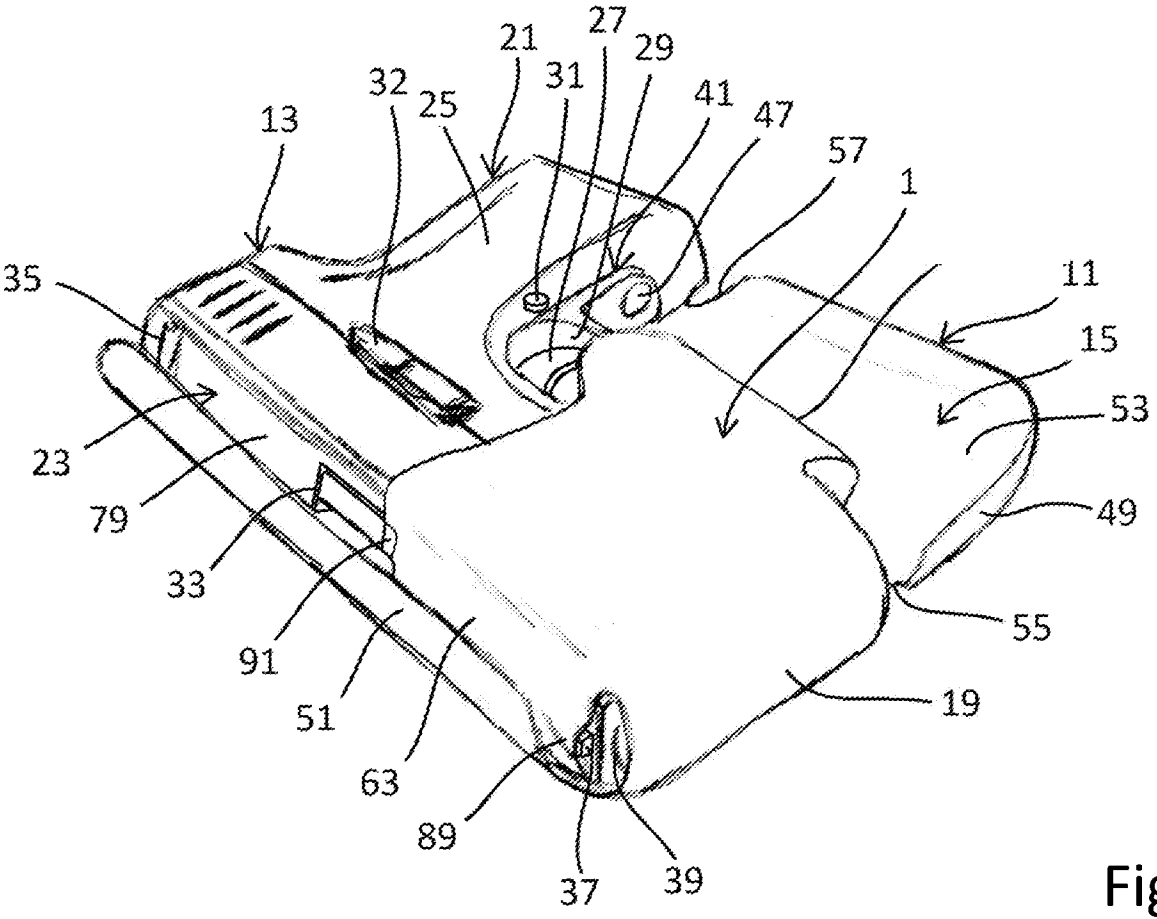
FIG. 1 is an oblique perspective view of a hinged holster according to this disclosure, a firearm being shown carried therein.
Figure 2:
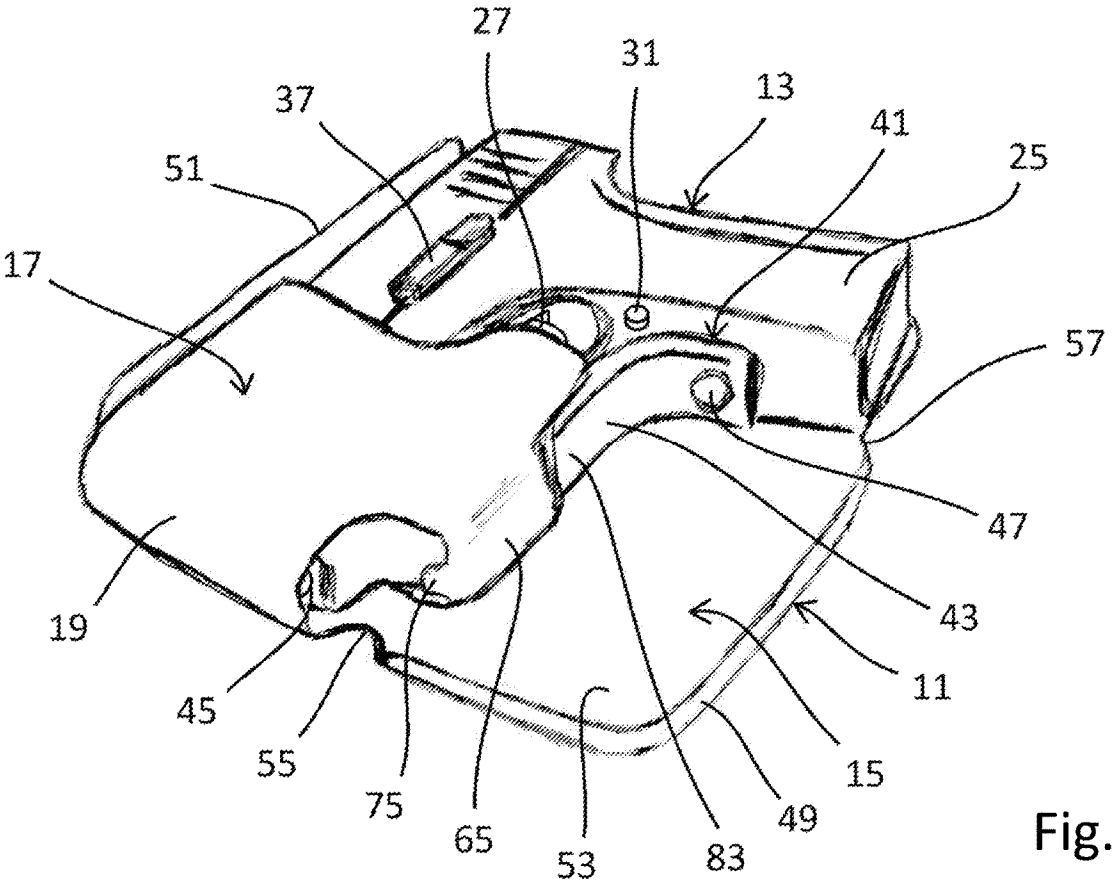
FIG. 2 is another oblique perspective view of the hinged holster of FIG. 1.
Figure 3:
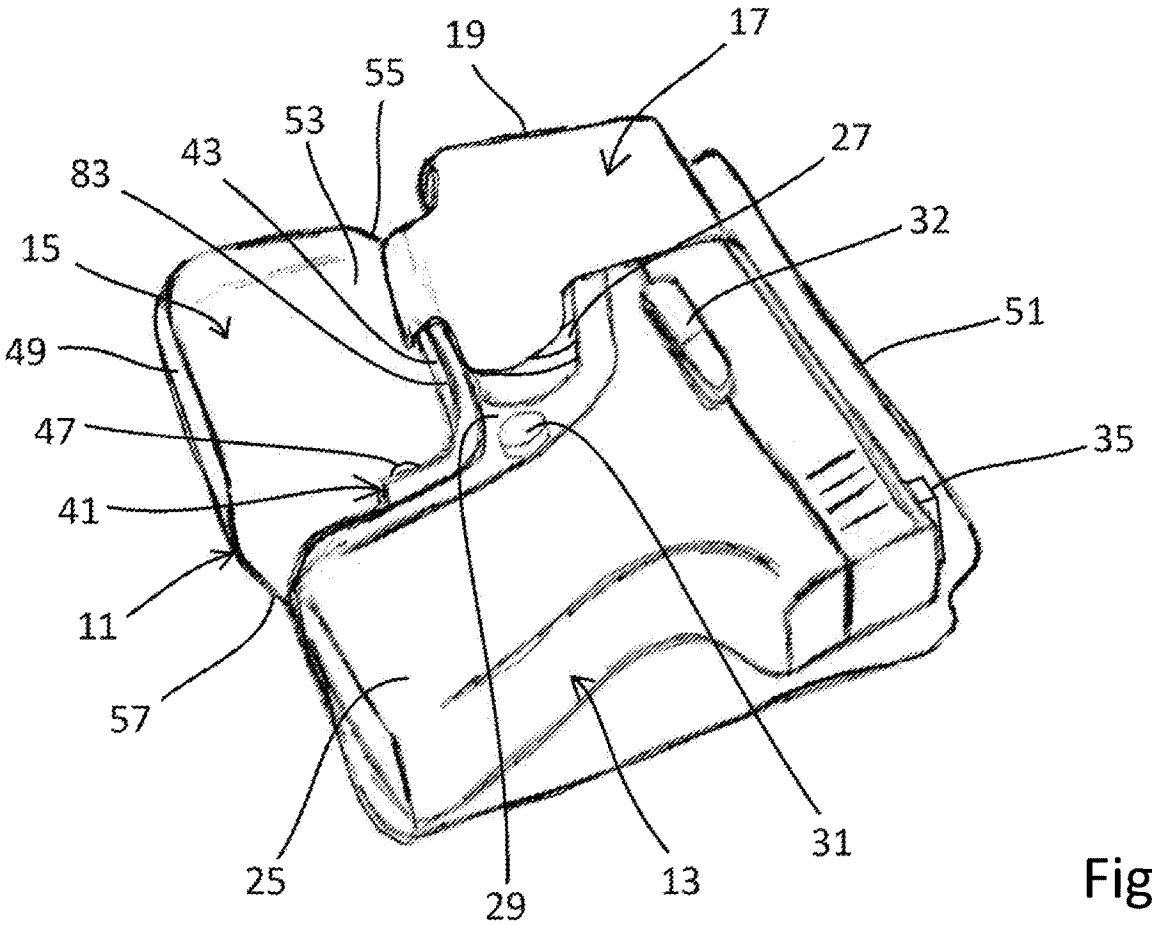
FIG. 3 is another oblique perspective view of the hinged holster of FIG. 1.
Figure 4:
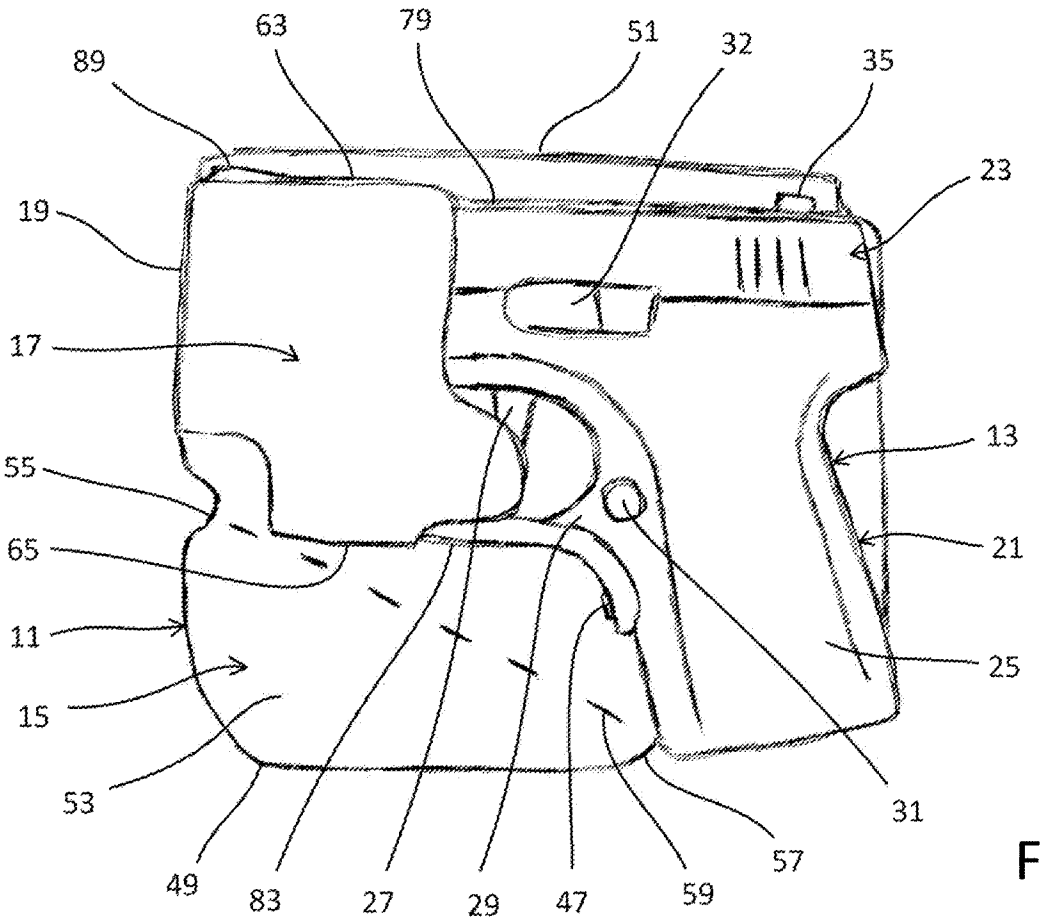
FIG. 4 is a left side view of the hinged holster of FIG. 1.
Figure 5:
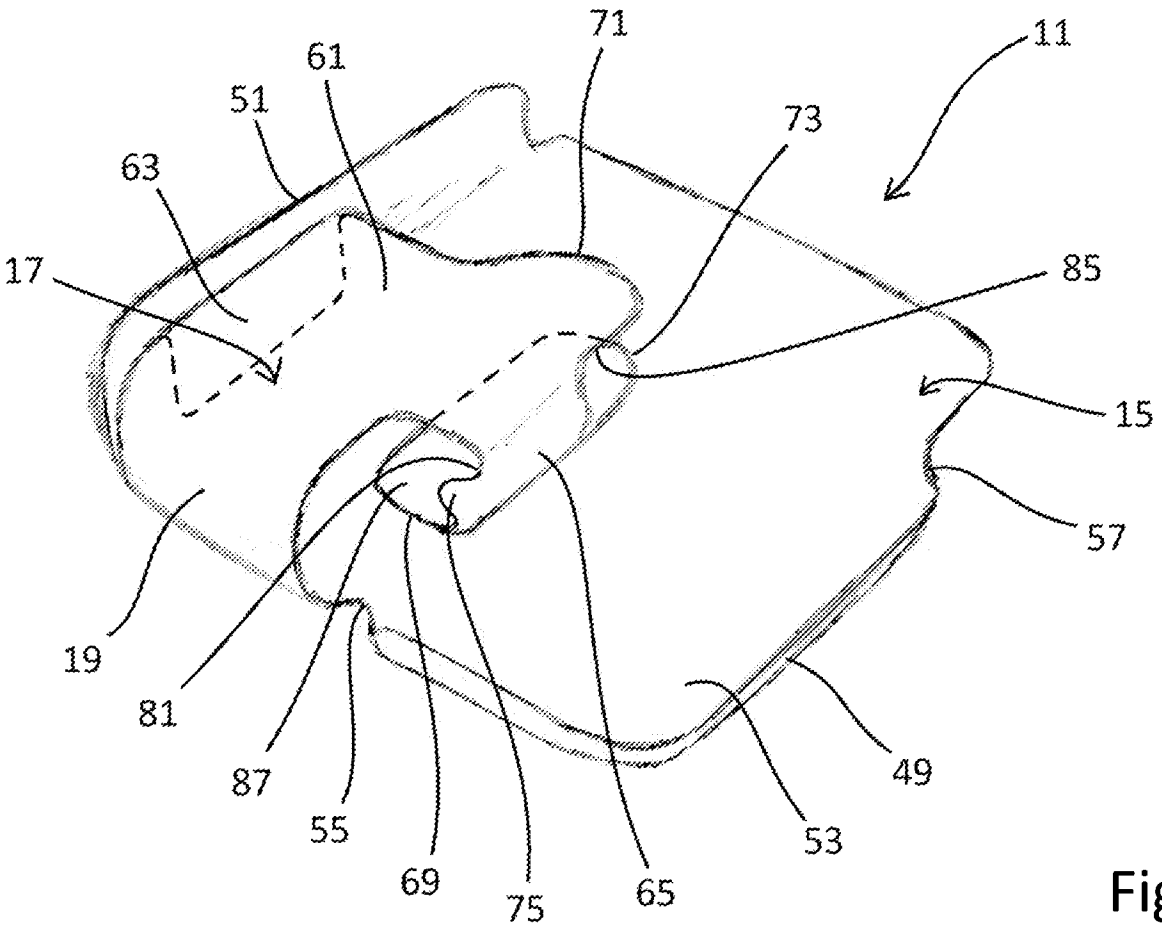
FIG. 5 is another oblique perspective view of the hinged holster of FIG. 1.
Figure 6:
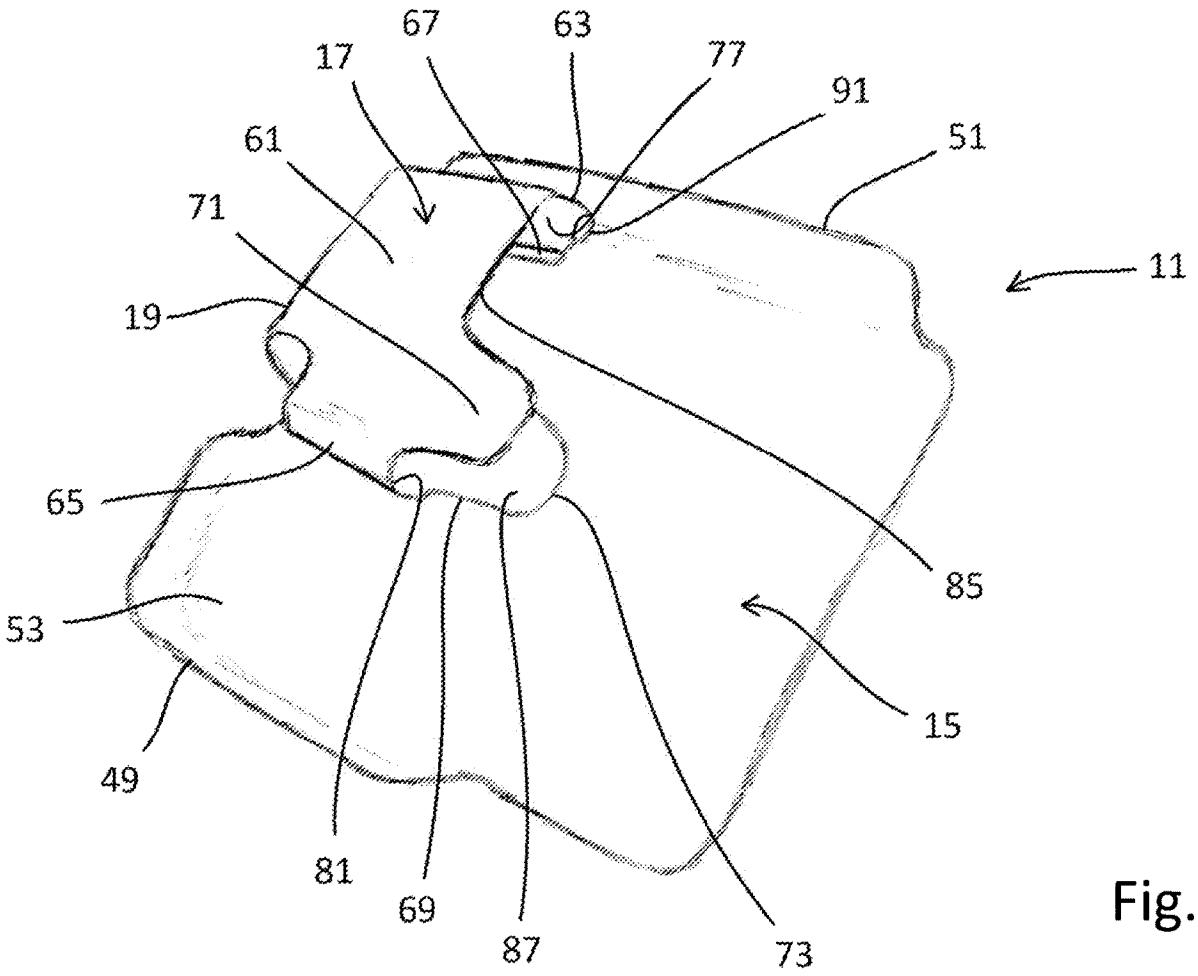
FIG. 6 is another oblique perspective view of the hinged holster of FIG. 1.

This disclosure claims priority to U.S. Provisional Patent Application 62/222,592, filed 23 Sep. 2015.

DETAILED DESCRIPTION

Illustrative embodiments of the subject matter of this disclosure are described below. All features of an actual implementation may not be described in this specification, and the development of any actual embodiment may include numerous implementation-specific decisions to achieve the developer's goals, which will vary from one implementation to another. Such development effort, though complex and time-consuming, would nevertheless be a routine undertaking for those of ordinary skill in the art having the benefit of this disclosure.

Reference may be made to the spatial relationships between various components and to the spatial orientation of components as both are depicted in the drawings. However, components (and assemblies of components) may be positioned in any appropriate location or orientation, and the descriptions should be understood to describe a relative relationship between the components or a relative spatial orientation.

A hinged holster according to this disclosure provides for concealment of a firearm and for enhanced accessibility to the firearm. The hinge allows a user to insert the fingers and palm of the draw hand between the firearm and a concealment plate for establishing or maintaining a grip, including an extended trigger finger adjacent the firearm, on the firearm prior to drawing the firearm from the holster.

The holster may be formed as a single piece, lacking stitches, fasteners, or adhesives. Alternatively, the holster may have separately formed components that are joined together. For example, the concealment plate, firearm enclosure, and hinge of a holster may each be formed from a different material, such as a polymer or leather, or each may be formed from the same material with different thickness or other characteristics.

The hinge provides significant improvements over prior-art holsters, including: 1) allowing for extending the trigger finger adjacent the firearm while gripping the holstered firearm; 2) allowing for one-piece embodiments; and 3) by eliminating the need for any protrusions or attachments on the concealment plate, thus allowing the firearm to also be drawn with no required movement away from the concealment plate for clearing protrusions or attachments.

FIGS. 1 through 6 illustrate the overall configuration of a holster 11 used for concealing a firearm 13. Holster 11 comprises concealment plate 15, enclosure 17 for carrying firearm 13 in a position very near or adjacent plate 15, and forward hinge 19 connecting plate 15 and enclosure 17. As shown, holster 11 is specifically configured for use in a generally rectangular garment pocket, such as a rear pants pocket, though holster 11 may be used in a front pants pocket or a suitably sized pocket of any type of garment. Alternatively, holster 11 may have a peripheral shape configured to improve use or appearance when carried in a pocket other than a rectangular pocket or for use in other locations. In addition, plate 15 may be configured for coupling to another object, such as a belt, allowing firearm 13 to be carried openly or for another plate or other type of enclosure to conceal firearm 13.

Holster 11 is shown configured for right-hand draw, though holster 11 may alternatively be configured for left-hand draw. Also, holster 11 is shown configured for use with a particular model of firearm having a particular laser sight, but the design of holster 11 can be modified for use with other models of firearms and attached accessories, such as laser sights and flashlights.

In this embodiment, holster 11 is formed from a single, unitary piece of plastic, eliminating the need for stitching, fasteners, or adhesives. Holster 11 may be formed, for example, from a pattern cut from a flat sheet or by other methods, such as injection molding. A preferred material is a thermoplastic, such as acrylic-polyvinyl chloride, which is marketed under the trademark Kydex®.

Firearm 13 comprises a frame 21 and slide 23. Frame 21 comprises grip 25, trigger 27, trigger guard 29, magazine catch 31, and slide stop 32. Slide 23 comprises ejection port 33, rear sight 35, front sight 37, and barrel 39. Firearm 13 is equipped with a laser sight 41, comprising a housing 43 attached to and enclosing the forward portion of trigger guard 29, a laser 45 carried within housing 43, and a laser activation switch 47 located adjacent a forward portion of grip 25.

Plate 15 is generally rectangular and planar, with a curled edge 49 and a curled slide cover 51. Firearm 13 is carried in holster 11 with the forward end of barrel 39 located near or within hinge 19 and with slide 23 generally parallel to and near slide cover 51. Slide cover 51 is preferably approximately the full length and width of slide 23, so as to provide a smooth appearance to holster 11 for both concealability and reduced wear to a garment due to sharp edges. Edge 49 is curled out of the plane of plate 15 to provide depth to corner 53, which is opposite slide 23 and grip 25, and this depth adds to concealability by mimicking the shape and thickness of a wallet. Edge 49 extends around the periphery of plate 15 from hinge relief 55 to grip relief 57. Reliefs 55, 57 cooperate to define a virtual hinge 59, allowing corner 53 to flex relative to the remainder of plate 15. Flexure of corner 53 about virtual hinge 59 provides plate 15 a limited ability to conform to the shape of an adjacent body part of the user, such as when a rear pants pocket is pulled tight against holster 11 while a user is seated. In a preferred embodiment, holster 11 is formed from Kydex having a thickness of approximately 0.060 in, which provides for sufficient rigidity for holster 11 while allowing for flexure of corner 53 and hinge 19. The termination of edge 49 at relief 57 also allows for an extended magazine to protrude from grip 25 and beyond the periphery of plate 15.

Hinge 19 is preferably a large-radius elastic (flexure) hinge, and the large radius provides for a long, and perhaps infinite, service life by avoiding plastic deformation and by reducing stresses and fatigue during use. In this embodiment, hinge 19 is formed from the same Kydex material and same material thickness as the remainder of holster 11.

Enclosure 17 is formed as a pocket that is sized to receive a forward portion of firearm 13, and enclosures of other embodiments may have various shapes and configurations. In this embodiment, enclosure 17 is formed to be generally C-shaped for rigidly holding and retaining firearm 13 within enclosure 17 while allowing for firearm 13 to be inserted and withdrawn from enclosure 17. As described below, the configuration of enclosure 17 also allows for separation between enclosure 17 (together with firearm 13) and plate 15 through relative rotation about hinge 19.

A cover plate 61 extends rearward from hinge 19 and acts as a support for the other components of enclosure 17. Top plate 63 and bottom plate 65 extend from cover plate 61, cantilevered plates 63, 65 being generally perpendicular to cover plate 61. As shown, top plate 63 has an optional extra flap 67 for engaging a beveled top edge of slide 23. An inner plate 69 extends from bottom plate 65, so that inner plate 69 is generally perpendicular to bottom plate 65 and generally parallel to cover plate 61. Trigger covers 71, 73 extend rearward from cover plate 61 and inner plate 69, respectively, for covering both sides of trigger guard 29 and trigger 27. A tab 75 extends from bottom plate 65 for acting as a stop to limit the forward movement of firearm 13 when inserted into enclosure 17.

Trigger covers 71, 73 and cover plate 61 extend rearward a sufficient distance to cover trigger 27 and to provide support for firearm 13, but the rear edge of enclosure 17 lies forward of magazine catch 31 and slide stop 32. If required for support of firearm 13 within enclosure 17 or desired for aesthetics, function, or comfort, alternative embodiments of holster 11 may have cover plate 61 and trigger covers 71, 73 extended rearward. It is preferred that enough material is used for enclosure 17 to cover trigger 27 and prevent movement of firearm 13 within enclosure 17, but the amount of material should be minimized to allow for an unimpeded grip on firearm 13.

To rigidly hold firearm 13 within enclosure 17, opposing surfaces of enclosure 17 are located adjacent firearm 13, and this configuration rigidly, but removably, captures a forward portion of firearm 13. In this embodiment, the C-shape locates opposing surfaces against top and bottom surfaces of firearm 13 and against side surfaces of firearm 13. When firearm 13 is holstered within enclosure 17, inner surface 77 of top plate 63 lies adjacent a top surface 79 of slide 23, and opposing inner surface 81 of bottom plate 65 lies adjacent a bottom surface 83 of housing 43 of laser sight 41. Surfaces 77, 81 cooperate to capture the forward portion of firearm 13, rigidly locating firearm 13 in the space between surfaces 77, 81 and preventing rotation of firearm 13 relative to enclosure 17. Likewise, inner surface 85 of cover plate 61 and inner surface 87 of inner plate 69 cooperate to rigidly locate firearm 13 in the space between surfaces 85, 87 and prevent rotation of firearm 13 relative to enclosure 17.

Many options exist for configuring enclosure 17 to retain firearm 13 within enclosure 17. For example, a front-sight catch 89 is shown formed as a convex pocket on a forward portion of top plate 63, and catch 89 is formed to fit over front sight 37. An advantage of using cantilevered top plate 63 and bottom plate 65 are that one or both plates 63, 65 can elastically deform as firearm 13 is inserted into or drawn from enclosure 17, allowing for compressive force against firearm 13 while in enclosure 17. This compression force and elastic deformation allows for catch 89 to snap over front sight 37 as firearm 13 is inserted and to provide resistance to the firearm moving from within enclosure 17. Likewise, a concave port detent 91 is located at a rear portion of top plate 63 and engages a portion of ejection port 33 for an additional retention device, detent 91 also relying on elastic deformation of one or both plates 63, 65 for insertion and drawing of firearm 13. Slide cover 51 is spaced from top plate 63 a sufficient amount to allow for any elastic deformation.

Figure 7:
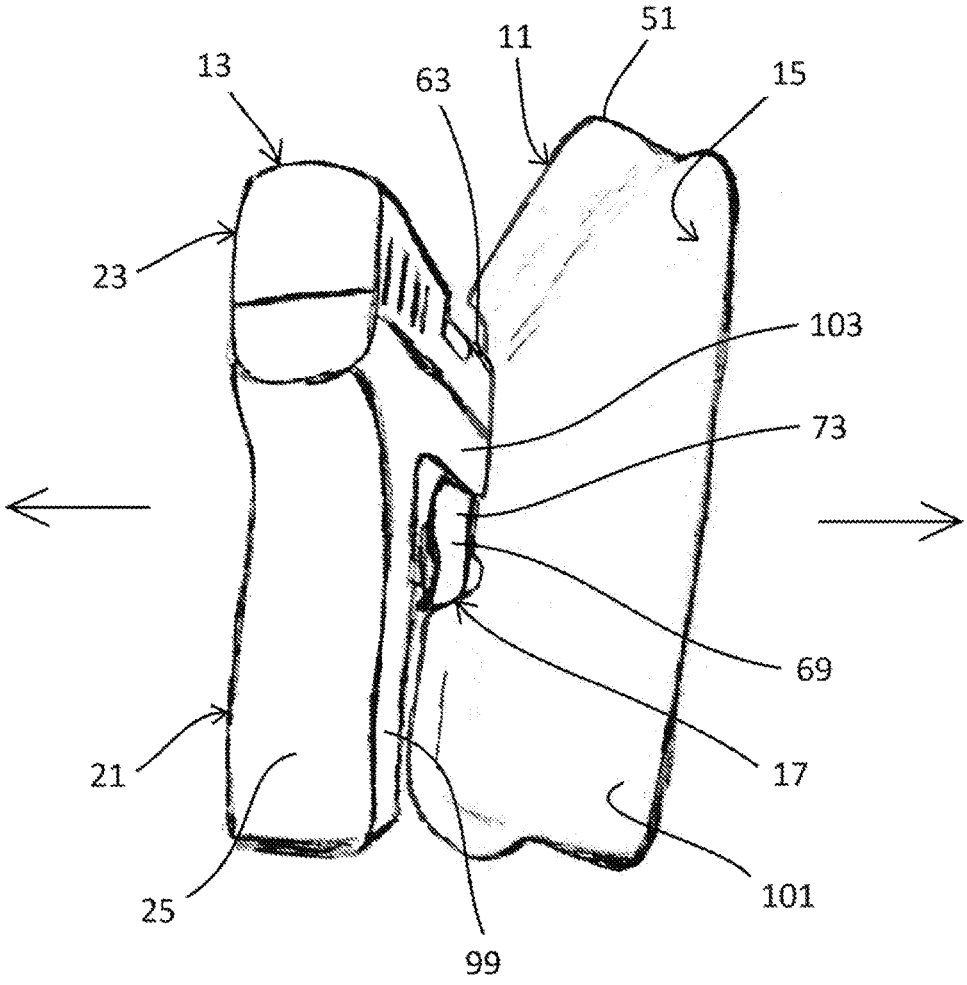
FIG. 7 is a rear perspective view of the hinged holster of FIG. 1, a firearm being shown carried therein and components of the holster being rotated relative to each other.
Figure 8:
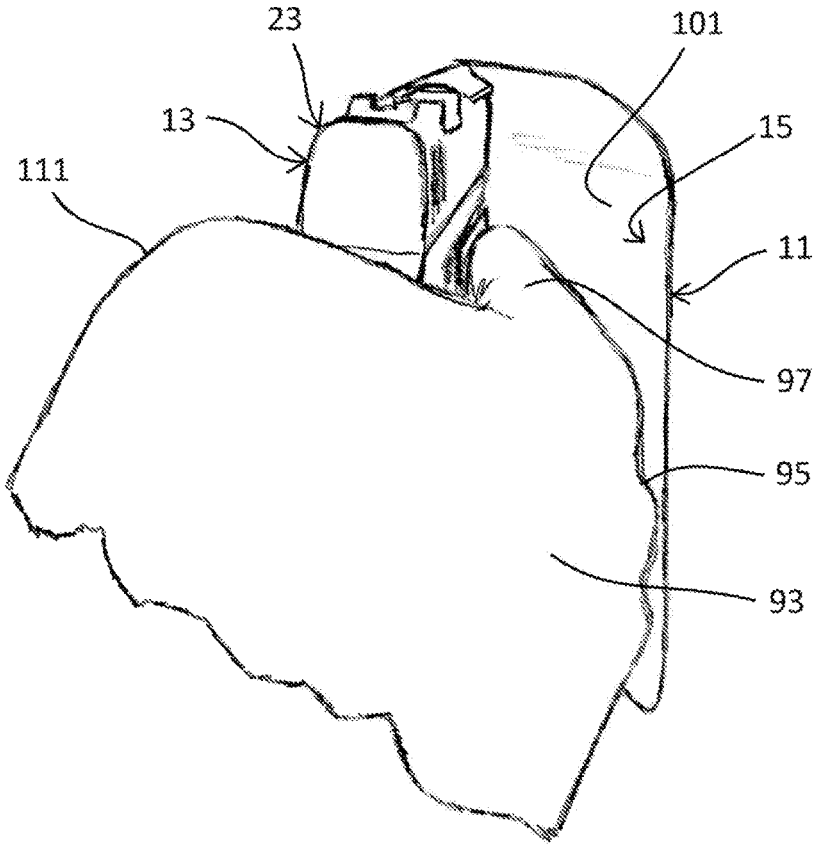
FIG. 8 is a rear perspective view of the hinged holster of FIG. 1, a hand shown gripping a firearm carried therein.

A significant advantage of holster 11 is that hinge 19 allows for separation of enclosure 17 and an inserted firearm 13 together from concealment plate 15, and FIGS. 7 through 10 illustrate this action and the advantage gained in drawing firearm 13. FIG. 7 is a view from the rear of holster 11, showing firearm 13 and enclosure 17 separated from plate 15 through relative rotation about (and elastic deformation of) hinge 19, and FIG. 8 shows a right hand 93 of a user gripping holstered firearm 13. The advantage to the design of holster 11 is that fingers 95 (including index finger 97) sliding between right surface 99 of grip 25 and inner surface 101 of plate 15 causes separation between firearm 13 and plate 15. This separation allows fingers 95 to enter holster 11 enough to wrap around grip 25, but the separation also allows index finger 97 to slide along right surface 103 of frame 21 and/or against inner plate 69, positioning index finger 97 in the preferred location during drawing of firearm 13.

Figure 9:
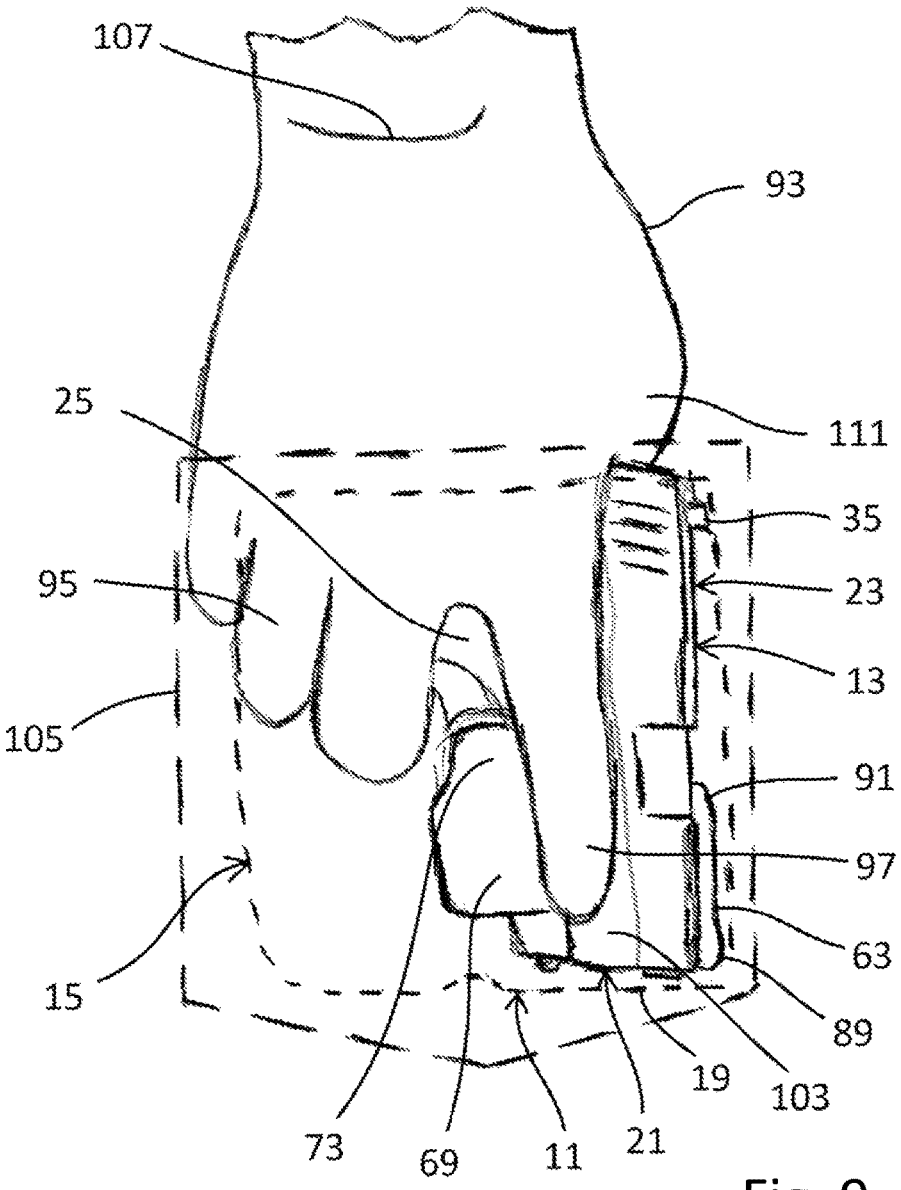
FIG. 9 is a right side view of the hinged holster of FIG. 1, a portion of the holster being shown in phantom, a hand shown gripping a firearm carried therein.
Figure 10:
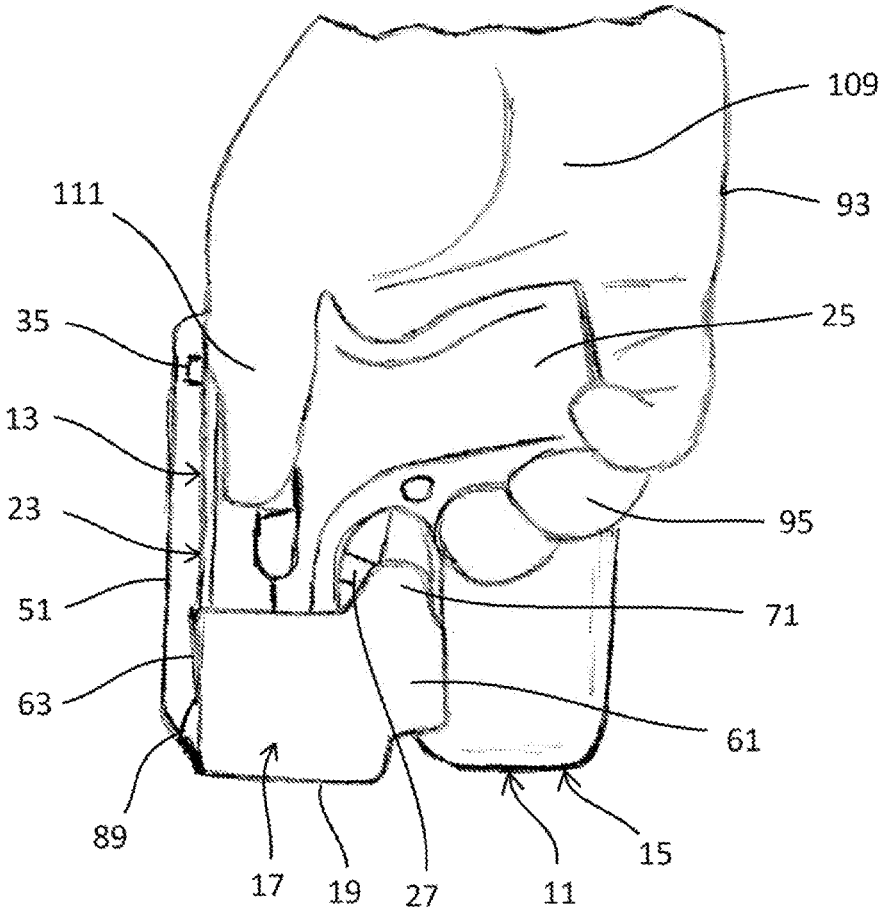
FIG. 10 is a left side view of the hinged holster of FIG. 1, a hand shown gripping a firearm carried therein.

FIGS. 9 and 10 are side views of hand 93 gripping a holstered firearm 13. FIG. 9 illustrates the right side, or outside, view of holster 11, with plate 15 shown in phantom to allow viewing of hand 93 and firearm 13. As described above, holster 11 has the advantage of allowing index finger 97 to extend forward and along surface 103 of frame 21, while inner plate 69 and trigger cover 73 keep index finger 97 from entering trigger guard 29 or contacting trigger 27. A phantom outline of a rear pants pocket 105 has been added to show an example of how holster 11 may be used. Holster 11 may be used with or without optional ax-injury scar 107.

FIG. 10 illustrates the left side, or inside, view of holster 11. As described above, hand 93 is allowed to move between plate 15 and firearm 13, and fingers 95 wrap around grip 25. Based on the length of firearm 13 or length of index finger 97, fingers 95 may not achieve a complete encircling of grip 25, but tightening fingers 95 after drawing firearm 13 will force grip 25 further into hand 93 and against palm heel 109. It should be noted that as firearm 13 separates from plate 15, the rear portion of slide 23 is moved left from underneath slide cover 51. Thus, though thumb 111 is shown alongside slide 23, this separation allows thumb 111 to be placed on top of slide 23, such as for hooking thumb 111 over rear sight 35 to assist in drawing firearm 13.

It should be noted that firearm 13 may also be drawn from holster 11 without the need for insertion of all of fingers 95 into holster 11. For example, index finger 97 and thumb 111 may be inserted on opposite sides of firearm 13 for pinching firearm 13 and pulling firearm 13 from holster 11. This type of draw may be necessary when sufficient room around holster 11 is not available for allowing plate 15 and firearm 13 to move away from each other, such as may be the case when a user is seated and a pocket is pulled tight against holster 11. Because they are unnecessary to retain or rigidly hold firearm 13 in enclosure 17, it is preferable that there be no protrusions or attachments extending from inner surface 101 of plate 15, as these may prevent drawing of firearm 13 without the ability to separate plate 15 and firearm 13 by the required amount to clear the protrusions or attachments.

It should also be noted that enclosure 17 would require different configurations for different models of firearms and for the presence or lack of attached accessories. For example, for enclosure 17 to rigidly hold firearm 13 without laser sight 41 installed, top plate 63 and bottom plate 65 would need to be moved or extended rearward for providing properly located opposing surfaces to prevent rotation of firearm 13 within enclosure 17. For any embodiment of holster 11, it is very much preferred, though optional, that enclosure 17 include trigger covers 71, 73 that prevent index finger 97 or fingers 95 from entering trigger guard 29 or contacting trigger 27.

Figure 11:
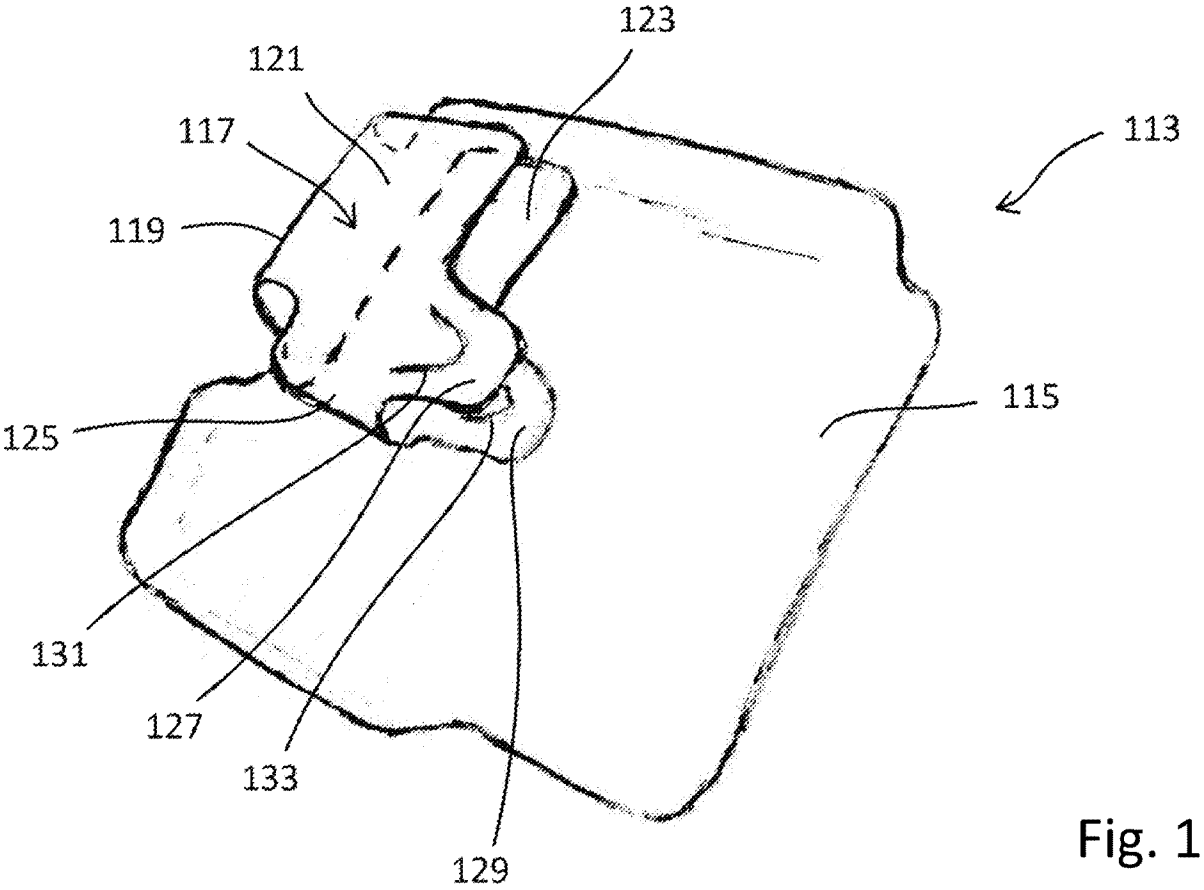
FIG. 11 is an oblique perspective view of another embodiment of a hinged holster according to this disclosure.
Figure 12:
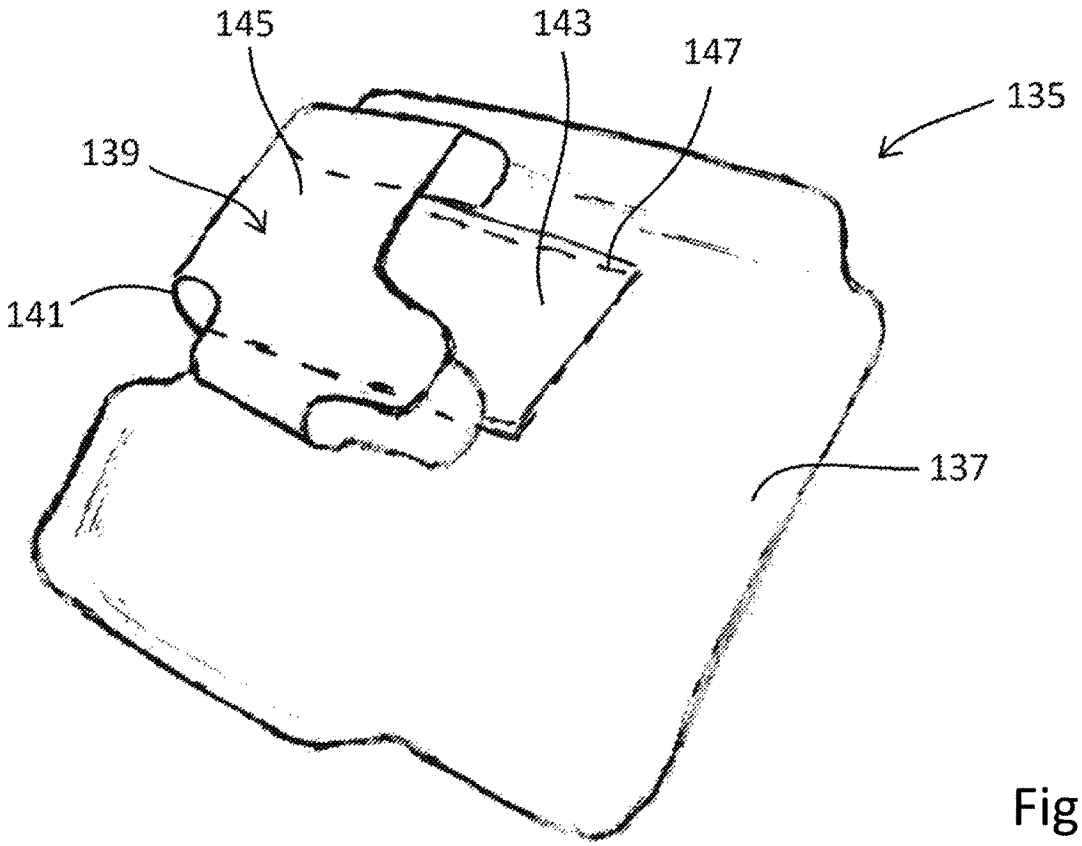
FIG. 12 is an oblique perspective view of another embodiment of a hinged holster according to this disclosure.
Figure 13:
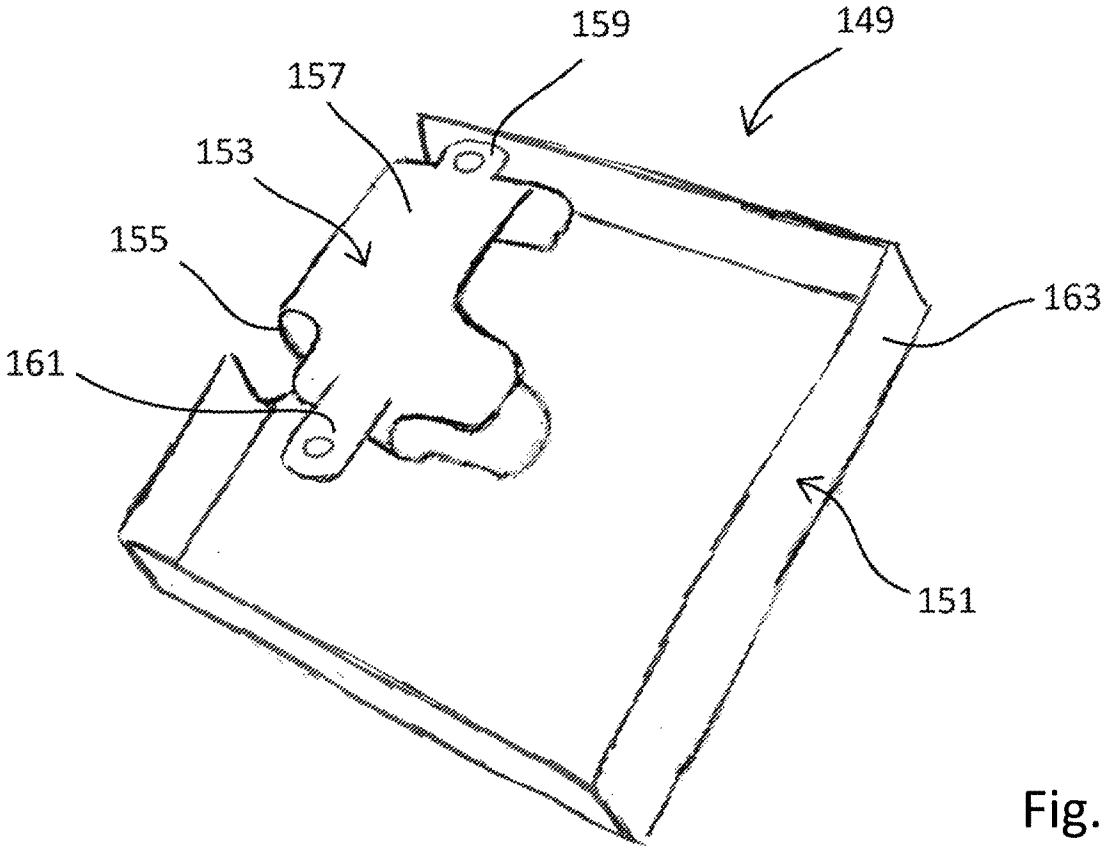
FIG. 13 is an oblique perspective view of another embodiment of a hinged holster according to this disclosure.

FIGS. 11 through 13 illustrate alternative embodiments of a forward-hinged holster according to this disclosure.

FIG. 11 shows a holster 113, which comprises a concealment plate 115, a firearm enclosure 117, and a forward hinge 119 connecting plate 115 and enclosure 117. Unlike the C-shape of enclosure 17 of holster 11, enclosure 117 is formed with a U-shape, defined by parallel cover plates 121, 123 and a lower plate 125 connecting plates 121, 123. Plate 121 is connected to hinge 119, allowing relative rotation of plate 115 and enclosure 117 about hinge 119. Plates 121, 123 have trigger covers 127, 129, respectively, extending from a rear edge. One option for retaining a firearm within enclosure 117 is the use of convex dimples 131, 133, which protrude inward toward each other for engaging the inside of a trigger guard, and elastic deformation of enclosure 117 allows a firearm to be inserted or drawn from enclosure 117.

FIG. 12 shows a holster 135, which comprises a concealment plate 137, a firearm enclosure 139, and a forward hinge 141 connecting plate 137 and enclosure 139. Enclosure 139 is constructed similarly to C-shaped enclosure 17 of holster 11, and hinge 141 allows relative rotation of plate 137 and enclosure 139 about hinge 141. However, unlike one-piece holsters 11 and 113, holster 135 has a separate concealment plate 137. Hinge 141 has a mounting plate 143 extending rearward from hinge 141 and generally parallel to cover plate 145. Mounting plate 143 is attached to plate 137 by any appropriate method, and this embodiment is shown attached with stitches 147, though fasteners or adhesive may additionally or alternatively be used. The advantage to this design is that plate 137 may be formed from a material other than the material used for enclosure 139 and hinge 141, such as forming plate 137 from leather, which would also allow mounting plate 143 to be inserted between layers of leather used to form plate 137. It should be noted that another alternative embodiment has plate 137 and hinge 141 as one piece, with enclosure 139 formed as a separate piece and attached to hinge 141 (see FIG. 18 and the associated description below). It should also be noted that all three components may be formed as separate pieces and attached together, which, for example, would allow hinge 141 to be formed of an elastic material different than that of plate 137 or enclosure 139.

FIG. 13 shows a hinged holster 149 configured for mounting to a surface. Holster 149 comprises a concealment plate 151, a firearm enclosure 153 constructed like enclosure 17 of holster 11, and a forward hinge 155 connecting plate 151 and enclosure 153. As in holsters described above, hinge 155 allows relative rotation of plate 151 and enclosure 153 about hinge 155. Enclosure 153 has a cover plate 157 comprising mounting components, such as tabs 159, 161 extending from cover plate 157, that are used for mounting enclosure 153 to a surface of an object. This allows concealment plate 151 to be rotated away from enclosure 153 for access to a firearm carried in enclosure 153. To provide for improved concealment of the firearm, plate 151 may have walls 163 that form a box shape.

FIGS. 14 through 17 illustrate side-hinge embodiments of holsters according to this disclosure.

Figure 14:
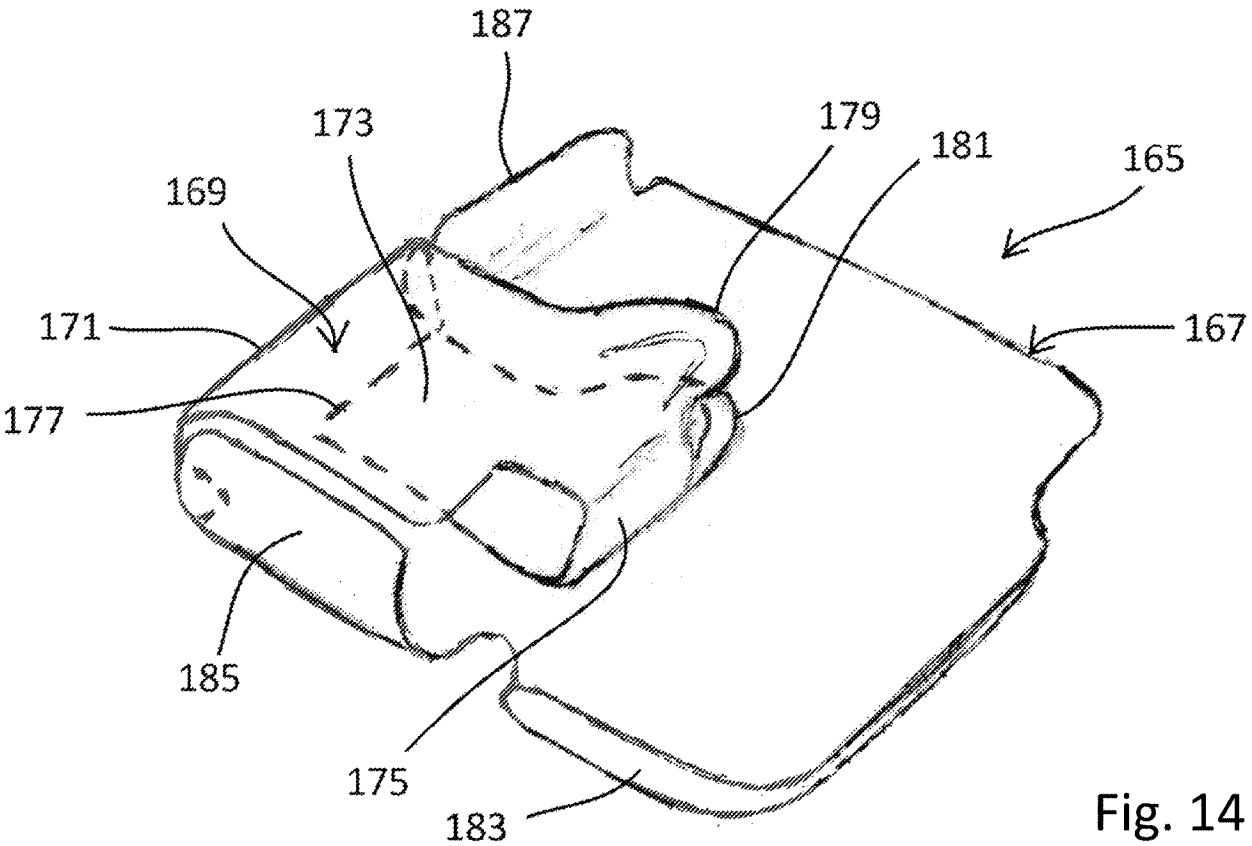
FIG. 14 is an oblique perspective view of another embodiment of a hinged holster according to this disclosure.
Figure 15:
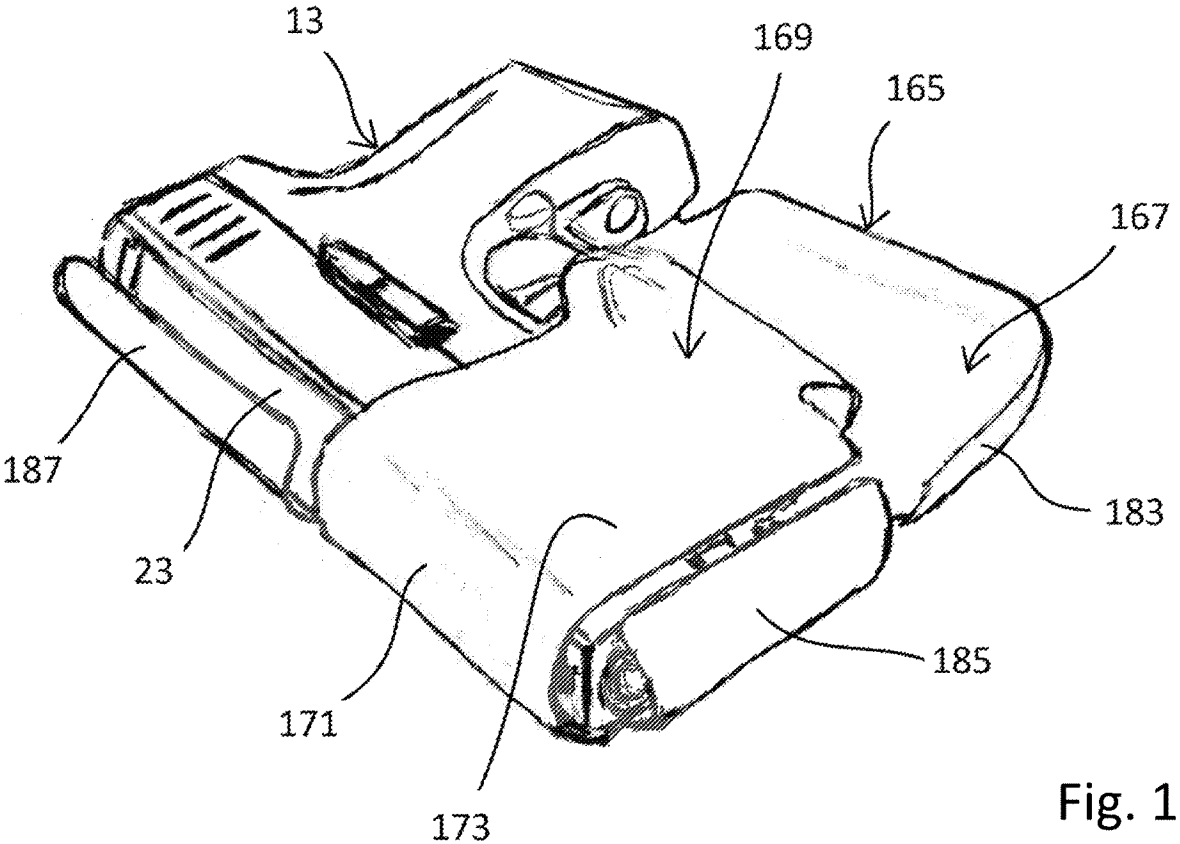
FIG. 15 is another oblique perspective view of the hinged holster of FIG. 14, a firearm being shown carried therein.

FIGS. 14 and 15 show side-hinged holster 165, which comprises a concealment plate 167, a U-shaped firearm enclosure 169 similar to enclosure 117 of holster 113 (FIG. 11), and a side hinge 171 connecting plate 167 and enclosure 169. Enclosure 169 comprises cover plate 173, bottom plate 175, and inner plate 177, plates 173, 177 having trigger covers 179, 181, respectively. Concealment plate 167 has a curled edge 183, muzzle cover 185, and slide cover 187. Unlike the holsters described above, in which a forward hinge wraps around the forward end of firearm 13, hinge 171 wraps over the top of slide 23 to adjoin cover plate 173. Hinge 171 allows relative rotation of plate 167 and enclosure 169 about hinge 171 to permit a user to obtain a draw grip, including an extended index finger as described above, by inserting fingers between plate 167 and firearm 13.

Figure 16:
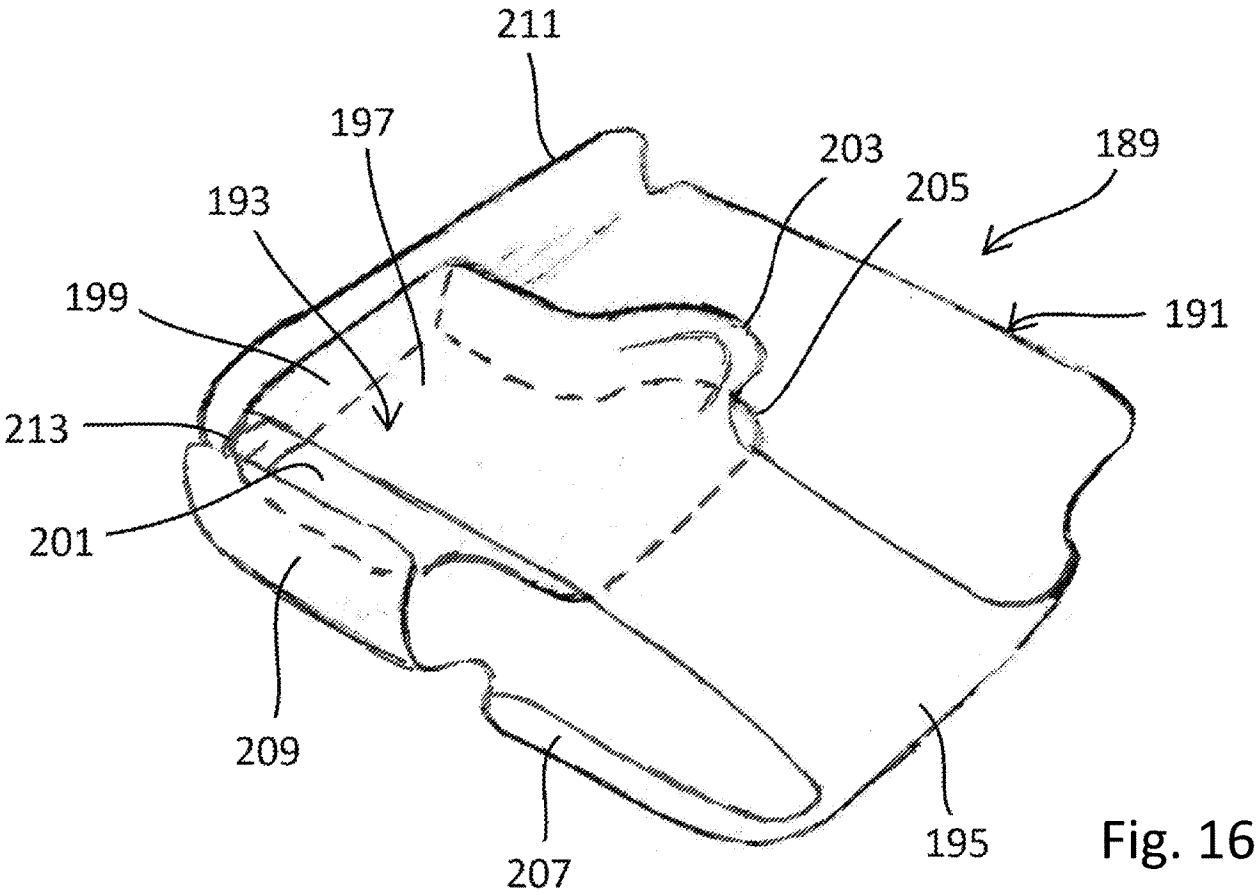
FIG. 16 is an oblique perspective view of another embodiment of a hinged holster according to this disclosure.
Figure 17:
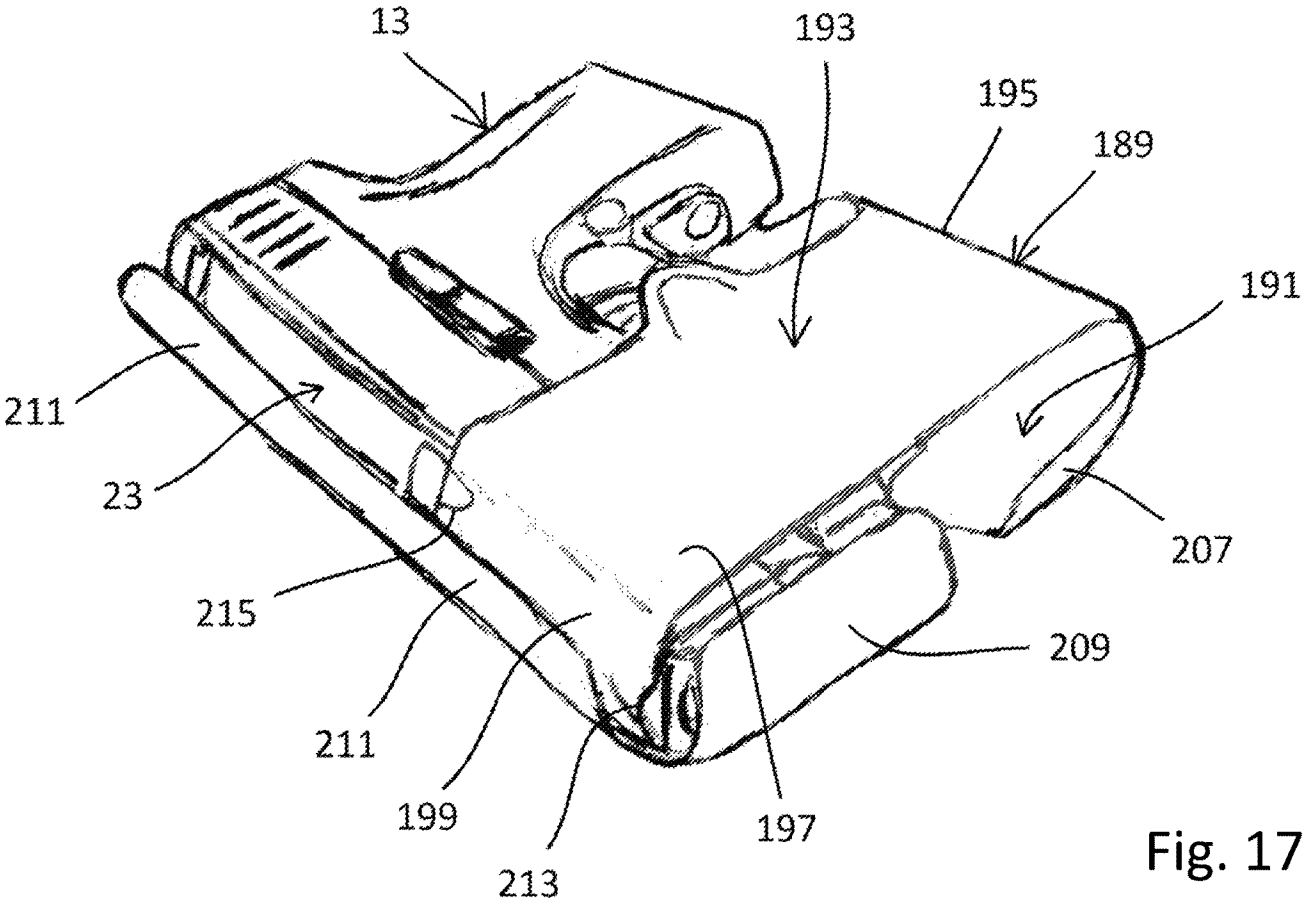
FIG. 17 is another oblique perspective view of the hinged holster of FIG. 16, a firearm being shown carried therein.

FIGS. 16 and 17 show side-hinged holster 189, which comprises a concealment plate 191, a U-shaped firearm enclosure 193, and a side hinge 195 connecting plate 191 and enclosure 193. Enclosure 169 has an inverted U-shape and comprises cover plate 197, top plate 199, and inner plate 201, plates 197, 201 having trigger covers 203, 205, respectively. Concealment plate 191 has a curled edge 207, muzzle cover 209, and slide cover 211. Top plate is shown with a front-sight catch 213 and ejection-port detent 215, which are optional retention devices. Hinge 195 is located at curled edge 207 and extends toward firearm 13 to adjoin cover plate 197. Hinge 195 allows relative rotation of plate 191 and enclosure 193 about hinge 195 to permit a user to obtain a draw grip, including an extended index finger as described above, by inserting fingers between plate 191 and firearm 13.

Figure 18:
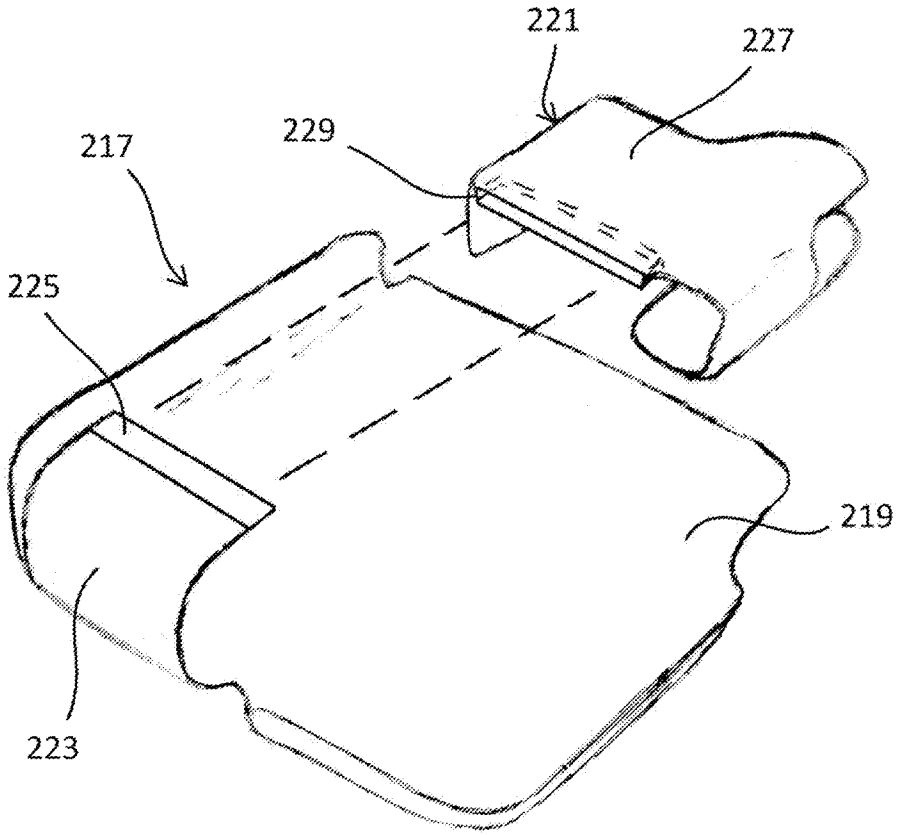
FIG. 18 is an oblique perspective view of another embodiment of a hinged holster according to this disclosure.

FIG. 18 shows a holster 217, which comprises a concealment plate 219, a firearm enclosure 221, and a forward hinge 223 connecting plate 219 and enclosure 221. Enclosure 221 is constructed similarly to C-shaped enclosure 17 of holster 11, and hinge 223 allows relative rotation of plate 219 and enclosure 221 about hinge 223. However, unlike one-piece holsters 11 and 113, holster 217 has a firearm enclosure 221 formed as a separate component and configured to be installed (shown exploded) on a mounting tab 225 of hinge 223. Enclosure 221 comprises a cover plate 227 with a slot 229 sized for receiving tab 225. Slot 229 is attached to tab 225 by any appropriate method, such as, for example, fasteners, adhesives, stitches, or any other appropriate method. The main advantage to this design is that it allows for installation by the manufacturer, distributor, seller, or user of a selected enclosure 221 sized and configured for a particular firearm, permitting customization of holster 217 before, at the time of, and after sale to the user. Another advantage to this design is that plate 219 and hinge 223 may be formed from a material other than the material used for firearm enclosure 221, such as forming plate 219 and hinge 223 from Kydex and forming enclosure 221 from another material, or vice versa. In addition, as described above for holster 135, plate 219 and hinge 223 could also be formed as separate components and from different materials.

It should be noted that additional embodiments of side-hinge holsters may specifically allow for limited torsional twisting of the cover plate and/or hinge during gripping or drawing of a firearm. It should also be noted that embodiments of side-hinge holsters may be configured for use as a mounted holster like holster 149, described above.

The particular embodiments disclosed are illustrative only, as the subject matter may be modified and practiced in different but equivalent manners apparent to those skilled in the art having the benefit of the teachings herein. Modifications, additions, or omissions may be made without departing from the scope of this disclosure. For example, hinged holsters according to this disclosure may incorporate any of the configurations, features, or components of the various alternative embodiments shown and/or described herein.

What is claimed is:

1. A firearm holster, comprising:

a plate;

a firearm enclosure configured to carry a firearm; and an elastic hinge coupling the plate to the enclosure for positioning the enclosure in a rest position adjacent the plate and in which the enclosure is oriented as substantially parallel to the plate, the hinge being undeformed in the rest position and allowing for relative motion between the plate and enclosure through elastic deformation of the hinge;

wherein relative motion about the elastic hinge during use allows for parts of a hand of a user to be inserted between the plate and enclosure when establishing or maintaining a grip on a firearm carried by the holster.

2. The holster of claim 1, wherein the holster is formed as a one-piece structure.

3. The holster of claim 1, wherein at least one portion of the holster is formed from a material having different characteristics than a material used to form another portion of the holster.

4. The holster of claim 1, wherein the hinge is located on a forward portion of the holster.

5. The holster of claim 1, wherein the hinge is located on a side of the holster.

6. The holster of claim 1, wherein the enclosure is configured to have a C-shape.

7. The holster of claim 1, wherein the enclosure is configured to have a U-shape.

8. The holster of claim 1, wherein the enclosure is configured to cover a trigger of a firearm carried by the holster.

9. The holster of claim 1, wherein the enclosure is configured to cover both sides of a trigger of a firearm carried by the holster.

10. The holster of claim 1, wherein the enclosure comprises features that removably retain within the enclosure a firearm carried by the holster.

11. The holster of claim 1, wherein the hinge and enclosure are formed together as a component, and the plate is formed as a separate component and coupled to the hinge.

12. The holster of claim 1, wherein the plate and hinge are formed together as a component, and the enclosure is formed as a separate component and coupled to the hinge.

13. The holster of claim 1, wherein the enclosure is sized and configured for carrying a particular model of firearm.

14. The holster of claim 1, wherein the enclosure is sized and configured for carrying a plurality of models of firearms.

15. The holster of claim 1, wherein the enclosure is configured for coupling to another object.

16. The holster of claim 1, wherein the plate is formed to generally have the shape of a rectangular box.

17. The holster of claim 1, wherein the enclosure comprises a slot configured for receiving a tab formed on the hinge.

18. The holster of claim 1, wherein the enclosure is detachable from the hinge.

19. A firearm holster, comprising:

a concealment plate;

a firearm enclosure configured to carry a firearm; and an elastic hinge coupling the plate to the enclosure and locating the enclosure adjacent and parallel to the plate in a rest position, the hinge being elastically undeformed in the rest position and allowing for relative motion between the plate and enclosure about the hinge through elastic deformation of the hinge;

wherein relative motion about the elastic hinge during use allows for parts of a hand of a user to be inserted between the plate and enclosure when establishing or maintaining a grip on a firearm carried by the holster.

20. A firearm holster, comprising:

a concealment plate;

a firearm enclosure configured to carry a firearm; and an elastic hinge coupling the plate to the enclosure and configured for holding a firearm carried in the enclosure adjacent and parallel to the plate in a rest position, the hinge being elastically undeformed in the rest position and allowing for relative motion between the plate and enclosure about the hinge through elastic deformation of the hinge;

wherein relative motion about the elastic hinge during use allows for parts of a hand of a user to be inserted between the plate and enclosure when establishing or maintaining a grip on a firearm carried by the holster.

* * * * *